US009834963B2

(12) United States Patent
Bendel et al.

(10) Patent No.: US 9,834,963 B2
(45) Date of Patent: Dec. 5, 2017

(54) LOCK MODULE FOR A MOTOR VEHICLE

(75) Inventors: Thorsten Bendel, Oberhausen (DE); Bernhard Drost, Isselburg (DE)

(73) Assignee: Kiekert AG, Heiligenhaus (DE)

( * ) Notice: Subject to any disclaimer, the term of this patent is extended or adjusted under 35 U.S.C. 154(b) by 443 days.

(21) Appl. No.: 13/989,870

(22) PCT Filed: Nov. 25, 2011

(86) PCT No.: PCT/DE2011/002037

§ 371 (c)(1),
(2), (4) Date: Aug. 22, 2013

(87) PCT Pub. No.: WO2012/092915

PCT Pub. Date: Jul. 12, 2012

(65) Prior Publication Data

US 2013/0328329 A1 Dec. 12, 2013

(30) Foreign Application Priority Data

Nov. 25, 2010 (DE) ..... 10 2010 062 000

(51) Int. Cl.
*E05B 17/00* (2006.01)
*E05B 81/06* (2014.01)
(Continued)

(52) U.S. Cl.
CPC ..... *E05B 81/06* (2013.01); *E05B 17/0004* (2013.01); *E05B 79/04* (2013.01);
(Continued)

(58) Field of Classification Search
CPC ..... E05B 17/0004; E05B 79/04; E05B 79/06; E05B 81/06; Y10T 292/1082; Y10T 29/49002
See application file for complete search history.

(56) References Cited

U.S. PATENT DOCUMENTS 4,934,748 A * 6/1990 Hayakawa ..... E05B 17/20 292/336.3
8,033,584 B2 * 10/2011 Akizuki et al. ..... 292/216
(Continued)

FOREIGN PATENT DOCUMENTS

DE 103 04 203 A1 7/2004
DE 103 54 854 A1 6/2005
(Continued)

OTHER PUBLICATIONS

International Search Report for corresponding PCT application No. PCT/DE2011/002037 dated Jun. 5, 2012.

*Primary Examiner* — Matthieu F Setliff
*Assistant Examiner* — Thomas Neubauer
(74) *Attorney, Agent, or Firm* — Renner, Otto, Boisselle & Sklar, LLP

(57) ABSTRACT

The invention relates to a lock module. The aim of the invention is to provide a lock module which can contribute to a reduction in the complexity of assembly. In order to achieve said aim, the lock module comprises a plurality of components, that is to say at least two components, which are selected from the following: a lock having a locking mechanism consisting of a pawl and a rotary latch, in particular a servolock; a drive, in particular an electric drive for the lock, particularly preferably for the servolock; an actuating lever system; a locking lever system; and a handle module having an opening handle, in particular an outer opening handle. The lock includes at least one drive which is movably mounted within the lock module. The drive can therefore be moved relative to the other one or more components of the lock module.

10 Claims, 1 Drawing Sheet

(51) Int. Cl.
*E05B 79/04* (2014.01)
*E05B 79/06* (2014.01)

(52) U.S. Cl.
CPC ..... *E05B 79/06* (2013.01); *Y10T 29/49002* (2015.01); *Y10T 292/1082* (2015.04)

(56) References Cited

U.S. PATENT DOCUMENTS

| | | | | |
|---|---|---|---|---|
| 9,382,732 | B2 * | 7/2016 | Arabia, Jr. ..... | E05B 77/44 |
| 2004/0262928 | A1 * | 12/2004 | Fukunaga ..... | E05B 79/04 292/216 |

FOREIGN PATENT DOCUMENTS

| | | | |
|---|---|---|---|
| DE | 10 2005 044109 | A1 | 3/2007 |
| GB | 2 253 435 | A | 9/1992 |
| JP | 2009-249836 | | 10/2009 |
| WO | 02/28672 | A1 | 4/2002 |
| WO | 2010/012272 | | 2/2010 |

* cited by examiner

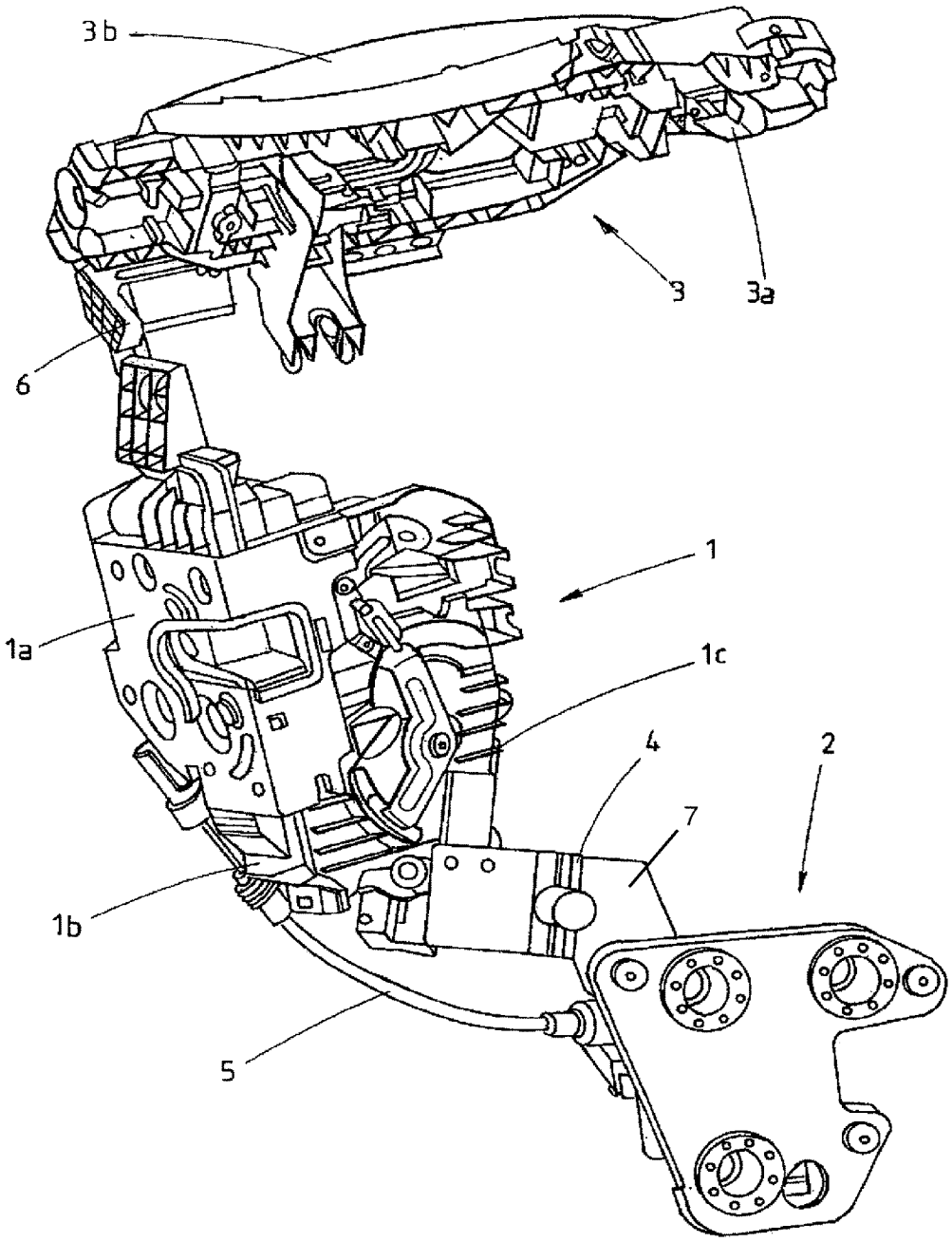
3b
3
3a
6
1
1a
1c
4
2
7
1b
5

LOCK MODULE FOR A MOTOR VEHICLE

The invention relates to a lock module with the characteristics of the generic part of claim 1 known, for instance, from published document DE 195 24 568 A1 as well as to an assembly procedure. A lock module is generally installed in a motor vehicle door and, in particular, a motor vehicle side door.

DE 195 24 568 A1 describes a motor vehicle door lock referred to as lock module, containing closing elements, a locking lever system, an actuating lever system acting upon the closing elements and an external handle. The closing elements comprise a locking mechanism consisting of a rotary latch and pawl. The locking mechanism is part of the lock for a motor vehicle.

A rotary latch of a motor vehicle lock contains a fork-shaped intake slot, accommodating a locking bolt of a vehicle door or of a lift gate when the vehicle door or lift gate is closed. The locking bolt then turns the rotary latch from an open position to a closed position. Once the rotary latch has reached a closed position, the locking bolt can no longer leave the intake slot of the rotary latch. In the closed position a pawl locks the rotary latch, so that it cannot be turned back to the open position.

Apart from moveable parts such as rotary latch and pawl, a motor vehicle lock also contains parts that are no longer moved once installed. These include a frame plate generally made from metal on which the rotary latch and pawl are rotatably mounted. A lock can also include a plastic housing that can be closed off by a cover plate.

Locks for a motor vehicle exist that have two closed positions that can be assumed in succession by the rotary latch during locking, i.e. the so-called auxiliary catch and the so-called main catch. To increase the level of comfort, a drive and, in particular, an electric drive can be provided, moving the rotary latch upon reaching the auxiliary catch position into the main catch position. Such a drive is described in the not pre-published German patent application 10 2009 026 921. A lock with such a drive is referred to as a servolock.

The above characteristics can separately or combined be part of the invention.

The not pre-published German patent application DE 2010 003 409 describes that the amount of assembly work associated with the installation of modules in a vehicle door has increased over time and, in particular, in case of the installation of modules in motor vehicle side doors. Modules to be installed can be electric windows, motor vehicle door locks, loudspeakers and drives for closing/opening mechanisms. The reason for the increase in assembly work is, amongst other things that the number of modules as well as other components such as side impact protection has grown, increasing space constraints. In addition a greater variety of vehicle door types exists, also increasing assembly requirements.

Based on the above, the invention has the task of providing a lock module able to contribute to reducing the required assembly work.

To solve this task, a lock module comprises the characteristics of claim 1. Advantageous embodiments are described in the sub-claims.

The lock module comprises a plurality of components, that is to say, at least two components, which are selected from the following:

- lock with a locking mechanism consisting of a pawl and rotary latch, in particular a servolock,

- drive, in particular an electric drive for the lock and particularly preferred for the servolock,
- actuating lever system,
- locking lever system,
- handle module having an opening handle, in particular an outer opening handle.

The lock module contains at least one drive, which is moveably mounted. The drive can therefore be moved relative to the other one or more components of the lock module.

The above components already feature moveable elements in prior art embodiments. A lock contains a plurality of moveable elements, such as a rotary latch, one or more pawls for securing the rotary latch in the auxiliary catch position or in the main catch position, one or several blocking levers for blocking a pawl, when the pawl secures the rotary latch. An opening handle is moveably mounted on at least one further part of the handle module. This moveable fixing of individual elements of a component serve to allow the operation of a lock module. The locking mechanism requires moveable parts to be able to close a door. The movability of a handle serves to open a door.

In contrast, the moveable mounting of the drive relates to a moveable connection that is generally not moved during operation once installed. In a preferred embodiment, the moveable connection cannot be moved in the installed state of the lock module, as the drive has been fixed during installation and can therefore no longer be moved. The movability thus only applies in case that the lock module is not installed in a door.

The moveable mounting can overcome installation problems. The movability can be used to facilitate the actual installation. At the start of an assembly the drive assumes another spatial position or arrangement relative to one or several further components of the lock module in comparison to the spatial position or arrangement assumed by the drive when installed relative to further components of the lock module. Moveable mounting can be used for adapting the lock module to different installation situations. In a first door type the drive assumes another position or arrangement relative to one or several further components of the lock module compared to an installation in another type of door.

The drive for the lock is, in particular, moveably connected to the lock and preferably with the housing, and particularly preferably with the cover plate of the lock. The desired moveable mounting can thus be easily achieved because of its design. Particularly preferred is the drive being physically separated from the lock by means of a web connection.

The moveable connection can be or include a flange connection. The drive is then flange-mounted. The desired connection can thus be achieved in an easy technical manner.

Preferably, the moveable connection can be locked and/or includes snap-in elements for locking the connection. This also facilitates assembly. A lock module can thus already be supplied by a supplier for assembly in the door in such a way that already at the start of the assembly the drive assumes a position that the drive should assume to facilitate the installation. The fixing and/or the latching elements ensure that the original position is initially maintained. By releasing the fixing, the position of the drive can then be changed in a manner facilitating the completion of the assembly. The latching elements or the resulting snap-in connection are preferably designed in such a way that, an increased force suffices to change the arrangement of the drive in relation to other components in the desired manner.

In one embodiment, the locking and/or latching elements are designed in such a way that the drive can only be fixed and/or snap-fitted in a predetermined arrangement. This prevents incorrect intermediate positions and/or arrangements of the drive in relation to other components of the lock module, which would hamper installation.

In one embodiment, the drive is connected to the lock by means of a flexible Bowden cable, in order to move or, that is to say, operate an element of the lock. The Bowden cable is a typical element for such a drive and, in particular, where these components are arranged separately from each other. The drive is therefore particularly suited for a moveable fixing, making installation considerably easier.

The drive serves, in particular, to move the rotary latch from an auxiliary catch position into a main catch position to increase the comfort when closing a door.

The drive is preferably an electrical drive and comprises preferably an electric motor or a shape memory alloy, i.e. an alloy, able to suddenly change its shape in case of a temperature change.

In one embodiment, the lock contains a first pawl for engaging the rotary latch in the auxiliary catch position as well as a second pawl for engaging the rotary latch in the main catch position. On the other hand, also a single pawl could suffice that engages the rotary latch in the auxiliary catch position and in the main catch position.

In one embodiment, the lock contains a blocking lever, able to block the pawl in its engaged position.

One embodiment provides a self-opening locking mechanism with a blocking lever. This means that the locking mechanism can open automatically, once the blockade by the blocking lever is lifted.

Below, the invention is explained in detail with reference to the FIGURE.

FIG. 1 shows a perspective view of a lock module according to the present invention.

FIG. 1 shows a lock module with a servolock 1, an electric drive 2 for lock 1 and a handle module 3 comprising a handle back plate 3*a* and a handle 3*b*. The drive 2 is moveably connected to the lock 1. The moveable connection can be or include a flange connection 7. The drive 2 is moveably connected to the servo lock 1 by means of the web 4. The servolock comprises a frame plate 1 *a*, a lock housing 1 *b* and a cover plate 1 *c*. The rotatable connection between the servo lock 1 and the electric drive 2 contains snap-in means, allowing snapping-in in at least two different snap-in positions. Generally, two different snap-in positions suffice to considerably simplify installation. It is therefore even preferable to only have two different fixing or snap-in positions allowing only two different fixed and/or snapped-in arrangements of the drive 2 in relation to the servolock 1. As a result, operating faults are regularly reduced. Because of the limited number of snap-in or fixing positions it is thus not possible, to snap-in or fix the drive in any position and thus also not in less favourable positions.

Using a Bowden cable 5, lock 1 arranged remotely from drive 2, can move the rotary latch of lock 1 from its auxiliary catch position into its main catch position. Because of its remote arrangement, the drive can be positioned in sections of a door not otherwise required. Because of the web connection 4, the lock module can be supplied readily preassembled for final installation in a door despite being separated from the drive 1 and lock 2.

Alternatively or additionally, the handle module 3 can, for instance, also have a rotary connection to the lock 1 to facilitate installation. It has, however, emerged that it is particularly important to provide a rotary connection for a drive 2, as handle 3 and lock 1 always have to assume a specified position in a door. The actual position of a drive can, on the other hand, be flexibly chosen or specified. A significant advantage is therefore only achieved if this fact is exploited by moveably fixing drive 2. In general, a rotatable fixing, able to follow the flexible Bowden cable, suffices. Where required, a different moveable fixing can, however, also be used. A respective fixing can, for instance, allow a sliding movement or even a folding movement as an alternative or in addition to a rotary movement, allowing a three-dimensional movement of the drive. For the above reasons it is therefore preferred that the handle 3 is for instance rigidly connected to the lock 1 by means of a web 6 as in this respect an exact position between said handle and lock is regularly required.

REFERENCE NUMBER LIST

1: Servolock
1 *a*: Frame plate
1 *b*: Lock housing
1 *c*: Cover plate
2: Drive for servolock
3: Handle module
3*a*: Handle back plate
3*b*: Handle
4: Web
5: Bowden cable
6: Web

The invention claimed is:

1. A lock module comprising:

a lock;

a drive connected to the lock for driving the lock;

a moveable connection that is connected between the lock and the drive, wherein the moveable connection is configurable in an uninstalled state and an installed state; and a handle module with an outer opening handle for operating the lock module;

wherein the moveable connection includes a web connection and latching elements for snap-fitting the moveable connection to the lock, wherein the drive is rotatable relative to the lock via the web connection for adjusting placement of the drive relative to the lock when the moveable connection is in the uninstalled state, and, wherein the drive is non-rotatable relative to the lock when the latching elements are snap-fitted to the lock and the moveable connection is in the installed state, and wherein the drive drives the lock when the outer opening handle is actuated when the moveable connection is in the installed state.

2. The lock module according to claim 1, wherein the drive is moveably connected to the lock at a lock housing or at a cover plate of the lock in the first state.

3. The lock module according to claim 1, wherein the moveable connection includes a flange connection, with the drive being flange mounted.

4. The lock module according to claim 1, wherein the drive is connected to the lock by means of a Bowden cable for its operation.

5. The lock module according to claim 1, wherein the drive is an electrical drive including an electric motor or a drive containing a shape memory alloy.

6. The lock module according to claim 1, wherein the web connection provides a rigid and fixed connection between the drive and the lock.

7. The lock module according to claim 6, wherein a second web connects the handle module to the drive and provides a rigid and fixed connection.

8. A door of a motor vehicle containing an installed lock module according to claim 1.

9. The door according to claim 8, in which the moveable connection of the lock module cannot be moved once the lock module is installed in a door.

10. A procedure for installing a lock module according to claim 1 in a door, wherein the moveable connection is moved before and/or during installation.

* * * * *